US005588185A

United States Patent [19]

Covi et al.

[11] Patent Number: 5,588,185

[45] Date of Patent: Dec. 31, 1996

[54] ZIPPER CLOSURE

[75] Inventors: Christian Covi, Fritzens; Werner Steinlechner, Jenbach, both of Austria

[73] Assignee: D. Swarovski & Co., Wattens, Austria

[21] Appl. No.: 437,979

[22] Filed: May 10, 1995

[51] Int. Cl.[6] ..... A44B 19/02; A44B 19/06

[52] U.S. Cl. ..... 24/381

[58] Field of Search ..... 24/381, 382, 385, 24/389, 390, 399, 401, 403, 415

[56] References Cited

U.S. PATENT DOCUMENTS 2,495,033 1/1950 Sullivan .

FOREIGN PATENT DOCUMENTS 183046 2/1955 Austria .
2304341 9/1973 Germany .

*Primary Examiner*—Peter M. Cuomo
*Assistant Examiner*—Robert J. Sandy
*Attorney, Agent, or Firm*—Wenderoth, Lind & Ponack

[57] ABSTRACT

A zipper closure includes teeth having decorative stones. The teeth engage each other by respective support surfaces, the extension (h) of which in the direction of the zipper closure is at most as large as the largest diameter (D) of the decorative stones.

10 Claims, 3 Drawing Sheets

ZIPPER CLOSURE

BACKGROUND OF THE INVENTION

The invention relates to a zipper closure with symmetrical teeth of plastic formed on two bands, the teeth extending normal to the direction of the bands. Decorative stones or similar items are imbedded in the teeth, and the teeth arranged on one band and the facing teeth on the other band are offset in the direction of the bands and contact one another in the closed condition of the zipper closure at support surfaces which engage behind one another. Such support surfaces extend at an angle of less than 45°, preferably less than 15°, to the direction of the zipper closure. In the closed condition of the zipper closure middle points of the decorative stones are arranged in a straight line.

It is relatively simple to provide zipper closures with decorative stones, when one accepts that the stones will be arranged along a zig-zag path or line when the zipper closure is closed (see U.S. Pat. No. 2,495,033). To be able to arrange the decorative stones in a straight line, it has already been proposed (see AT-PS 183 046) to design the teeth of the zipper closure symmetrically to the dividing plane and not symmetrical with respect to a plane normal to the direction of the band. In such case, each tooth has a spherical projection which projects from one side edge and an opening arranged on an opposite side edge and complementary to the projection. The spherical projection of one tooth of two adjacent teeth engages in the opening of the other tooth. A closure of this kind resists an unintended separating of the bands only slightly, whereby the spherical projections can easily be strained so much that they break off.

In an arrangement previously used by applicants (which is illustrated only in a prospectus of the Jewel Fastener Corp.), the teeth attached to a band broaden from portions of attachment thereof continuously toward free ends thereof, thus forming slightly divergent trapezoidal shapes as viewed in plan elevation. This type of arrangement of teeth has the disadvantage that the teeth engage behind one another only slightly and the zipper closure therefore easily can be torn open in the direction of the band.

DE-Os 23 04 341 discloses a zipper closure with decorative stones and support surfaces extending parallel to the bands rather than normal thereto. Narrowest portions of the teeth are, however, so small that practically no space remains for the arrangement of decorative stones. Therefore, contoured teeth carrying the zipper closure and rectangular plates carrying the decorative stones are arranged above one another. This, however, makes the zipper closure unnecessarily thick or leads to the teeth being so flat that an assured hold is endangered.

SUMMARY OF THE INVENTION

The object of the invention is to provide that the entire height of each tooth is made effective for holding the zipper closure closed. This is achieved in that support surfaces of the teeth are formed in material of the teeth surrounding the decorative stones in the plane of the teeth, and that the dimension of each such support surface in the direction of the band is at the most equal to the largest diameter of the decorative stones. According to the invention, it is assured that the distance between adjacent decorative stones aligned in a row is not larger than the diameter of the decorative stones. A sufficient anchoring of the stones is guaranteed, however, when the extension or dimension of the support surfaces in the direction of the band (which is significantly smaller than the distance between the stones) is only half as great as the largest diameter of the stones.

In is advantageous when the contour of the free end of each tooth is designed as a part of a circle or an ellipse. In this way channels provided in the free ends of the teeth are anchored sufficiently on the opposite band, and it remains possible that the teeth converge from portions of attachment thereof to the band to the support surfaces. This in turn allows the connection between the bands and the teeth to be made by injection molding. Zipper closures in which the length of the teeth is the same as the width of the closed zipper closure could until now not be completely separated. For the zipper closure of the invention this is possible, in contrast, by providing the end of a band with a flexible connector, flexibility being achieved by an appropriate choice of material or by suitable notching. It is assumed that these measures would also be successful for teeth with altered outer contours.

BRIEF DESCRIPTION OF THE DRAWINGS

Details of the invention are explained in detail with reference to the accompanying drawings.

DETAILED DESCRIPTION OF THE INVENTION

Figure 1:
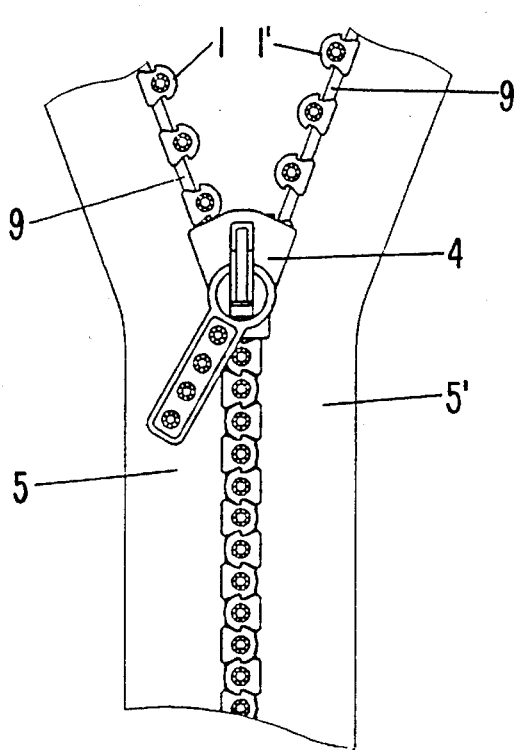
FIG. 1 is a top or elevation view of a zipper closure.

The zipper closure shown in FIG. 1 comprises two bands 5, 5', on which respective rows of teeth 1, 1' are arranged offset in the longitudinal direction. Edge beads or webs 9, 9' of the bands 5, 5' serve to support teeth 1, 1' and teeth 1, 1' are attached to beads or webs 9, 9' by injection molding during production thereof. Decorative stones 3, for example made of lead crystal, are molded at the same time in respective upper surfaces 15 of the teeth. A slider 4 typically serves to open and close the zipper closure.

Figure 2:
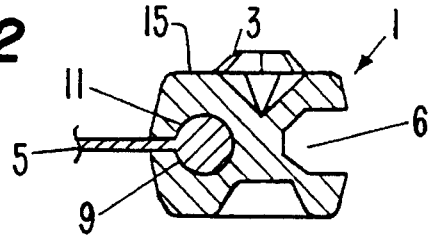
FIG. 2 is an enlarged longitudinal section through a tooth.
Figure 3:
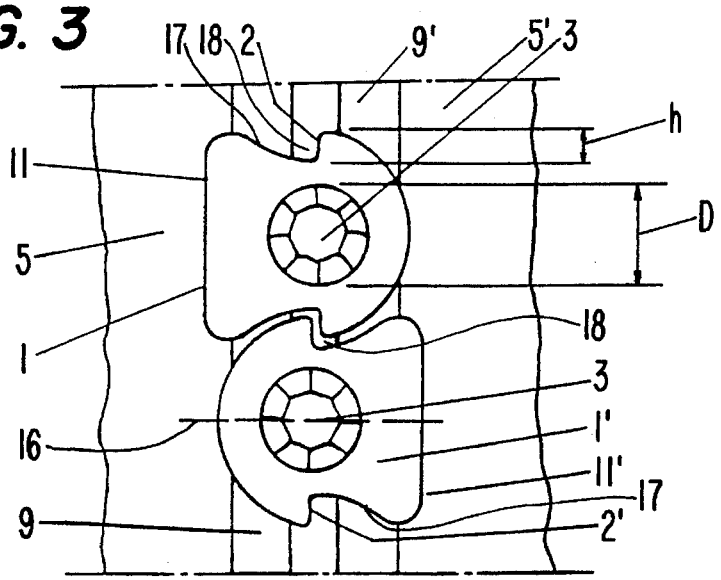
FIG. 3 is an enlarged top view of two adjacent teeth.
Figure 6:
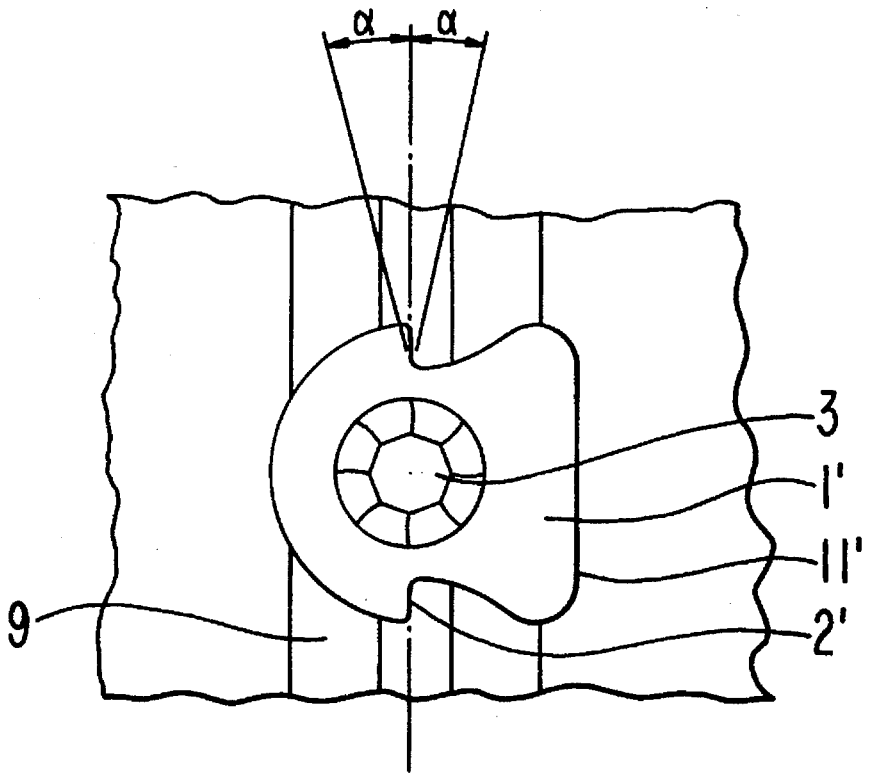
FIG. 6 is a partial view similar to FIG. 3 but schematically illustrating a modification thereof.

As is evident from FIGS. 2 and 3, contact areas of the teeth 1, 1' confronting and abutting one another in the closed position are designed prismatically, such that the areas of contact encounter no resistance to a vertical shifting of the teeth relative to one another (i.e. shifting in a direction perpendicular to the plane of FIG. 3), aside from friction. The anchoring of the teeth 1, 1' normal to the plane of the bands 5, 5' results thus that channels 6, 6' formed in free ends of the teeth 1, 1' receive the beads or webs 9, 9' of the opposing band 5, 5'. So that this is possible, the teeth 1, 1' must have a length i.e., dimension transverse to the longitudinal direction, which approximately corresponds to the width of the closed zipper closure. Each tooth 1, 1' has side surfaces 17 that converge, in elevation or top view, starting from a base 11, 11' to a narrowest area or portion thereof, from which support surfaces 2, 2' extend outwardly substantially parallel to the longitudinal direction of bands 5, 5'. The free end of each tooth 1, 1' has approximately the form of a half ellipse. As will be apparent from the drawings, each tooth has a configuration that is symmetrical in the length dimension thereof, i.e. relative to a center plane 16 that extends normal or transverse to the longitudinal direction of the bands. Further, each support surface 2, 2' defines with a respective side surface 17 a recess 18 to receive a complementary portion of an adjacent tooth in the closed position of the zipper closure. As shown in FIG. 3, each recess 18 is entirely open-ended at opposite ends thereof in the direction of thickness of the tooth. Further, although support surfaces 2, 2' are illustrated in FIG. 3 as extending in directions substantially parallel to the longitudinal direction of bands 5, 5', surfaces 2, 2' can extend in directions that deviate from such longitudinal direction by an angle α of no more than 45°, preferably less than 15°, as shown in FIG. 6.

The invention is based on the idea that the decorative stones 3 can be arranged in a straight line and at a narrow spacing in comparison to their size, when the support surfaces 2, 2' are kept correspondingly small, which in turn is possible due to their extension at a sharp angle to the direction of the teeth 1, 1'. In the illustrated embodiment, the extension h of each support surface 2, 2' in the direction of the bands 5, 5' amounts to about a third of the diameter D of the decorative stones 3. In this way each decorative stone 3 is surrounded by a satisfactory amount of plastic material of the respective tooth, and still the distance between the stones 3 in a row with one another is significantly smaller than their diameter.

The concrete configuration of the teeth 1, 1' with converging shanks and bow-shaped free ends allows optimal anchoring of each stone on the respective tooth and of each tooth on the respective bead or web 9, 9'. The selected form turned out to be favorable for opening and closing of the zipper closure. The complete separation and connection of the bands 5, 5' is problematic, which is why one has avoided until now constructing dividing zipper closures in which the closed zipper closure has the same width as the teeth, and the teeth overlap along their length.

Figure 4:
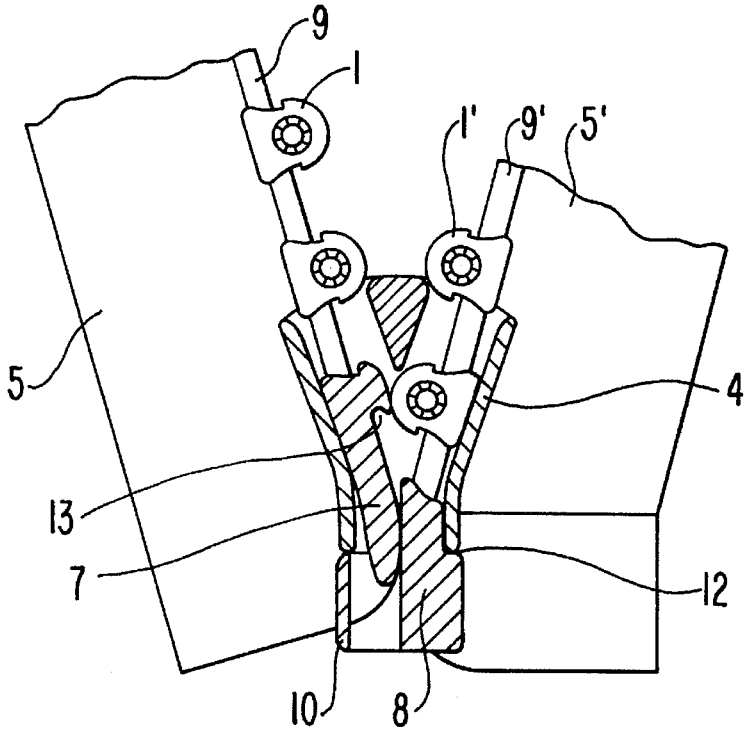
FIGS. 4 and 5 are partial sectional views of the zipper closure, respectively shown separated and in closed condition.
Figure 5:
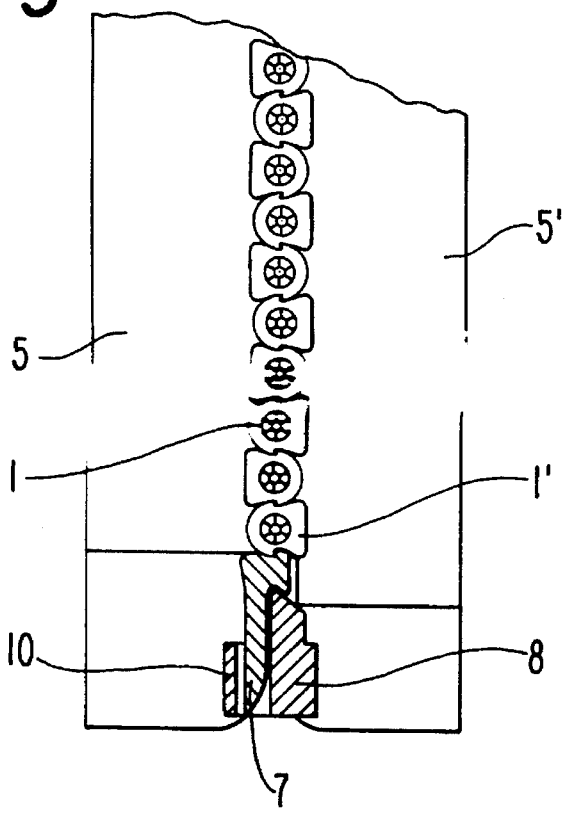

The ability to divide the described zipper closure is illustrated in FIGS. 4 and 5, in which slider 4 and a bushing 10, depicted as a box, are shown with a smooth front panel removed. A plastic part 8 is connected with the band 5' or its bead or web 9'. A stop surface or heel 12 of the plastic part 8 forms a stopper for the slider 4, which thus remains continually connected with the band 5'. Bushing 10 (shown cut away) is pushed in tightly with the end of the plastic part 8. The separation and connection of the two halves of the zipper closure result in the situation shown in FIG. 4. A connector 7, which is connected with the bead or web 9, is pushed in by the slider 4 and the bushing 10, until parts 7 and 8 reach the positions shown in FIG. 5. In this way, the correct arrangement of the opposing rows of teeth 1, 1' is guaranteed, and the closure can be brought into the closed position in accordance with FIG. 5 by shifting the slider 4. The described combination of parts 7 and 8 is achieved in the depicted arrangement by the connector 7 being produced from a material which is flexible enough to make the pushing in of the connector possible, although tightly enough that the connector 7 connects the transition between the positions shown in FIG. 4 and 5 when pushing together and separating the bands. To increase the flexibility of the connector 7, a modification provides for notching connector 7.

Even when the described tooth shape is altered, a dividable zipper closure still can be made with the same width of the closure equal to the tooth width. For the described tooth shape, the connector 7 can be made sufficiently flexible and sufficiently tight at the same time.

We claim:

1. A zipper closure comprising:

first and second longitudinal bands each having a longitudinal edge bead;

first and second rows of plastic teeth mounted on said beads of said first and second bands, respectively, such that said first row of teeth face said second row of teeth and are offset therefrom in the longitudinal direction of said bands;

each said tooth extending in a direction normal to said longitudinal direction and having a base end mounted on the respective said bead and a free end having formed therein a channel extending parallel to said longitudinal direction, each said tooth having a configuration that is symmetrical relative to a center plane of said tooth extending in said normal direction thereof, each said tooth having an upper surface having embedded therein a decorative stone, and each said tooth having on opposite sides thereof and on opposite sides of said center plane thereof respective support surfaces, each said support surface extending outwardly from and defining with an adjacent side surface of said tooth a recess that is open toward opposite ends thereof in a direction of thickness of said tooth;

said zipper closure having a closed position whereat said first and second rows of teeth mesh, with said channel at said free end of each said tooth receiving said edge bead of the respective other said band, with said opposite support surfaces of each said tooth being in abutting contact with support surfaces of adjacent teeth of said other band, and with middle points of said decorative stones of all of said teeth aligned in a straight line extending in said longitudinal direction.

2. A zipper closure as claimed in claim 1, wherein a dimension of each said support surface in said longitudinal direction is no greater than a maximum diameter of said decorative stone.

3. A zipper closure as claimed in claim 2, wherein said dimension is no greater than half said maximum diameter.

4. A zipper closure as claimed in claims 1, wherein each said support surface extends in a direction that deviates from said longitudinal direction by no more than 45°.

5. A zipper closure as claimed in claim 1, wherein each said support surface extends in a direction that deviates from said longitudinal direction by no more than 15°.

6. A zipper closure as claimed in claim 1, wherein each said support surface extends in a direction substantially parallel to said longitudinal direction.

7. A zipper closure as claimed in claim 1, wherein each said support surface extends to and intersects said upper surface of the respective said tooth.

8. A zipper closure as claimed in claim 1, wherein each said tooth has a dimension in said normal direction thereof approximately equal to the width of said zipper closure in said closed position thereof.

9. A zipper closure as claimed in claim 1, wherein said free end of each said tooth has a contour in the form of part of a circle or an ellipse.

10. A zipper closure as claimed in claim 1, wherein said side surfaces of each said tooth converge from said base end thereof to respective said support surfaces thereof.

* * * * *